United States Patent [19]

Fierro

[11] 4,045,061

[45] Aug. 30, 1977

[54] DECORATIVE ARTICLE FORMING SUPPORT

[76] Inventor: Mary M. Fierro, 11619 Downey Ave., Downey, Calif. 90241

[21] Appl. No.: 676,938

[22] Filed: Apr. 14, 1976

[51] Int. Cl.[2] ..... B65H 69/04

[52] U.S. Cl. ..... 289/18

[58] Field of Search ..... 28/15; 289/1.2, 1.5, 289/18

[56] References Cited

U.S. PATENT DOCUMENTS

| | | | |
|---|---|---|---|
| 248,669 | 10/1881 | Sackett | 28/15 |
| 254,258 | 2/1882 | Barbour | 28/15 |
| 254,288 | 2/1882 | Dimmick | 28/15 |
| 1,203,781 | 11/1916 | Ratycia | 28/15 |
| 2,395,981 | 3/1946 | Walker | 28/15 |
| 3,688,357 | 9/1972 | Nielsen | 28/15 |

*Primary Examiner*—Louis K. Rimrodt
*Attorney, Agent, or Firm*—Victor Sepulveda

[57] ABSTRACT

Herein described is a decorative article forming supporting device which includes a base portion substantially curved upwardly on each end one end being somewhat higher than the other. The higher end has a replaceable anchor pin assembly which includes a plurality of upwardly extending spaced pins for holding the yarn, string or the like from which the decorative article is formed. The other upwardly extended end has a plurality of spaced V-shaped slots whereby the yarn or string is stretched across the supports from the pins and inserted into the corresponding slot.

2 Claims, 6 Drawing Figures

DECORATIVE ARTICLE FORMING SUPPORT

BACKGROUND OF THE INVENTION

This invention relates to a decorative article forming support and more particularly to a novel and improved macrame supporting board used when making decorative articles.

In the field of arts and crafts one of the recent most popular crafts is that of forming decorative articles from yarn, strings and ropes commonly known as macrame. An example of one of the articles made in the craft of macrame is a plant hanger that is an article for hanging plants in their containers from the roof or ceiling. Other articles include personal wearing articles such as necklaces, bracelets and the like. Basically, the string, yarns or ropes, whichever the case may be, is twisted, tied, woven, etc., to form the preferred shapes and thereby forming the desired article.

Heretofore, the gathered ends of the yarn were allowed to hang free without support or placed on a nail or other support hook and the bitter ends of the yarns are allowed to hang free. This would cause a hardship for the artisan because these bitter ends hanging free like this would become mixed up and sometimes tangle.

SUMMARY OF THE INVENTION

These disadvantages are overcome by the present invention whereby a support is provided for securing the gathered ends as well as the bitter ends providing a neat and orderly method of forming decorative articles by the art commonly known as macrame.

Briefly described, the present invention provides a decorative article forming support including a base portion which is flat and substantially elongated. Each end of the base portion extends upwardly therefrom and is used for extending the yarn therebetween for forming the decorative article therefrom in the art of macrame.

One end of the upwardly extended end of said base portion may be somewhat higher than the other end for ease in viewing the art work during the form thereof. This higher end has a plurality of extending spaced apart pins to which the gathered ends of the art work is attached. The other lower upwardly extending end of the base portion has a plurality of V-shaped slots therein for securing and arranging the bitter ends of the yarn, rope or string, whichever is used during the formation of the art work.

A plurality of spaced holes are provided through the base plate. Upwardly extending elongated pins are then positionable into selected ones of said plurality of spaced pins to be used as a guide or marker to indicate ro the artisan where changes in the design of the art work is to occur.

DESCRIPTION OF THE DRAWINGS

These and other features and advantages will become more apparent to those skilled in the art when taken into consideration with the detailed description wherein like reference numerals indicate like and corresponding parts throughout the several views and wherein.

DESCRIPTION OF THE SHOWN EMBODIMENT

Figure 1:
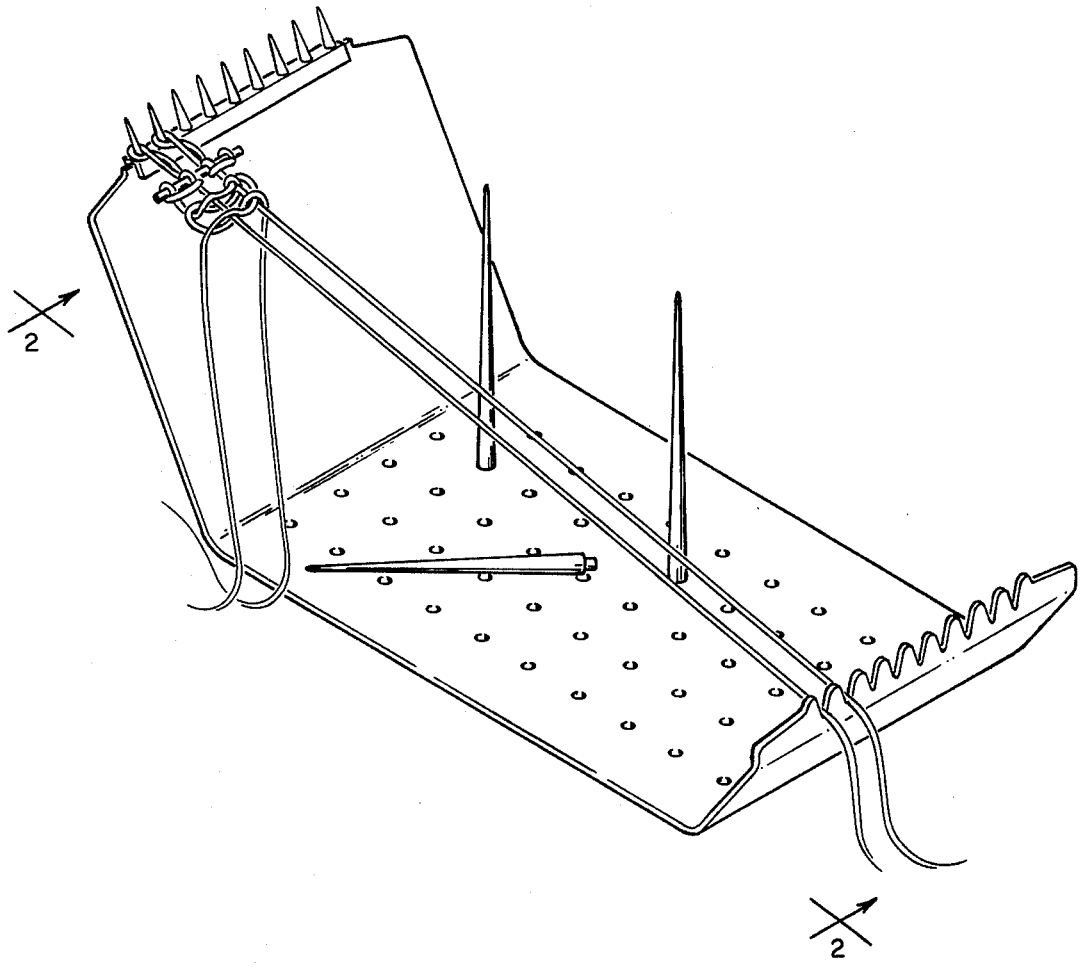
FIG. 1 is a perspective view of the Decorative Article Forming Support of the present invention showing a piece of the art work therein.
Figure 2:
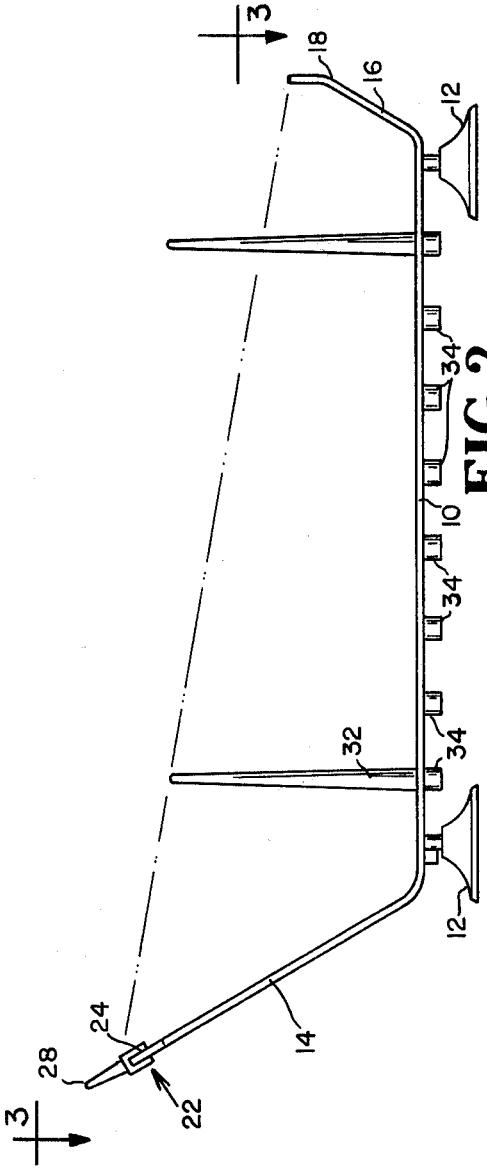
FIG. 2 is a side view of the present invention taken along the lines 2—2 of FIG. 1.

Turning now to a more detailed description of the present invention as shown as but one embodiment in the drawings FIGS. 1 and 2 best show a base 10 which is substantially flat and has four rubber suction cups 12 which are secured to the bottom of the base 10 in a suitable manner such as screws or nuts and bolts (not shown). The suction cups 12 can then be used to secure base 10 to a work table or the like so that it remains stationary while the art work is being formed.

End 14 extends upwardly from base 12 and shown at angle of about 45°-60° in the shown embodiment therefrom. End 16 extends upwardly from the base 12 and on the other end of the base 12 spaced from end 14. End 16 is also angled about 45°-60° from the base 12 and then is formed back to about a 90° at area 18 from end 16.

Figure 4:
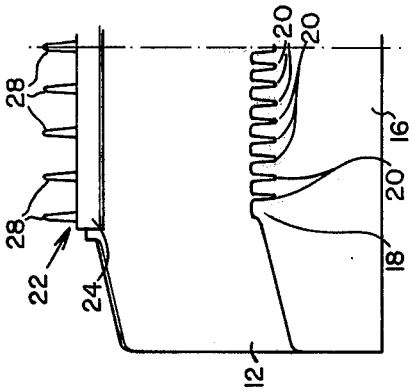
FIG. 4 is a partial end view of the present invention taken along the lines 4—4 of FIG. 3.

As shown in FIGS. 1 and 4, the top end 16 has a plurality of spaced V-shaped slots 20 along the top edge thereof which hold the bitter ends of the art work to be explained in more detail hereafter.

Figure 5:
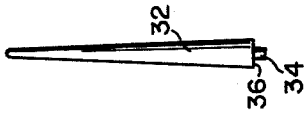
FIG. 5 is a perspective view of a replaceable anchor pin assembly as used in connection with the present invention.

Disposed on end 14 is an anchor pin assembly 22 as shown in FIG. 5 which comprises an elongated bar 24 having a slot 26 which is cut into the bar 24 and which fits snugly on the top of end 14 of the base 10. A plurality of pins 28 extend upwardly from the bar 24 on the end opposite the slot 26 and are used to hold the secured ends of the art work.

Figure 6:
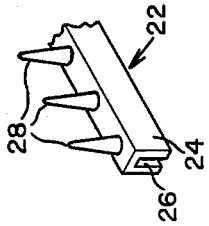
FIG. 6 is a view of the indicator pin used with the present invention removed from the base thereof.
Figure 3:
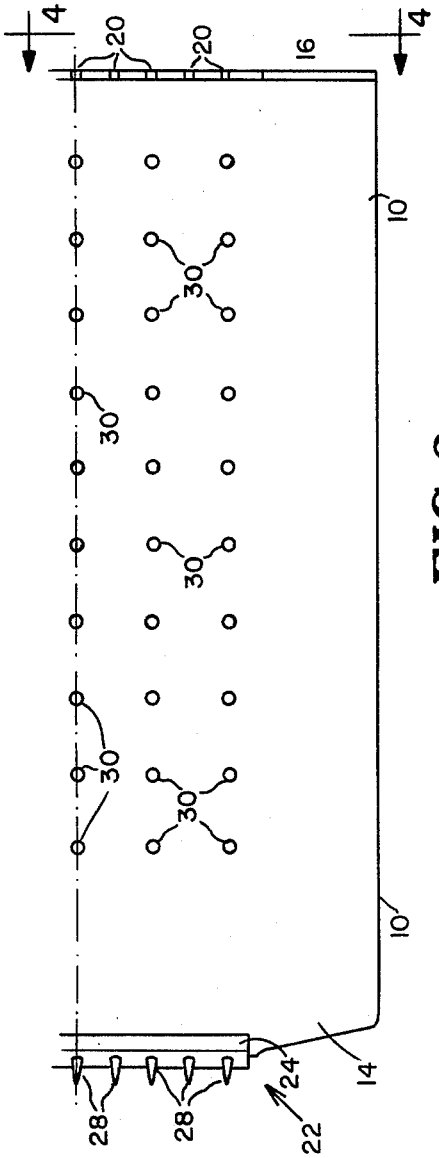
FIG. 3 is a partial top view of the present invention taken along the lines 3—3 of FIG. 2.

A plurality of spaced holes 30 are positioned through the base 10 as shown in FIG. 3. Upwardly extending marker pins 32 are then removably inserted into the holdes 30 and used to indicate certain marker spaces on the art work. As shown in FIG. 2 matching receptacles 34 may be placed below the base 10 aligned with holes 30 for holding the pins 32. Referring to FIG. 6 pin 32 has a smaller portion 34 which supports the pin 32 on the base 10 by the lip 36.

In using the decorative art work support of the present invention the yarn, rope or string used in the craft of macrame is secured to anchor pins 28 on end 14 and stretched across the base 10 and secured onto end 16 by placing the yarn down into the slots 20 therein. Thus the ends of the art work can be easily separated in a neat uniform pattern yet held firmly in place when not in use.

In order to indicate to the user when a change in the design or pattern is to take place, an indicator pin 32 is placed into a respective hole 30.

What is claimed is:

1. A decorative article forming support including:

a support portion having an upwardly extending first end and an upwardly extending second end, said first end being relatively longer in length than said second end so that said first end extends above said second end, wherein the area between the extended ends of said first end and said second end define a plane whereby said decorative article is adapted to be positioned, said first end and said second end being angled away from each other, a plurality of V-shaped slots placed on said second ends and adapted to securely hold selected end of the decorative article being formed, and removably mounted means on said first end for holding the end opposite said selected end of the decorative article being formed, said means including an elongated bar having a slot disposed in an elongated plane thereof, said slot being adapted to be snugly placed over said first end thereof and secure said means to said end, and a plurality of spaced pins extending from said bar on a side opposite said slot, whereby said decorative article being formed is adapted to be positioned between said pins and said V-shaped slots.

2. The decorative article forming support as defined in claim 1 wherein said support includes a substantially rectangular base portion having a plurality of spaced openings therein, and further including a plurality of elongated marker pins adapted to be positioned in selected ones of said plurality of openings and being of sufficient length so that when they are positioned vertically into said openings they extend between said base and the plane in which said decorative article being formed is placed, one end of each pin being formed so that when placed in one of said plurality of openings in said base they will extend upwardly without passing through said opening.

* * * * *